US006154967A

United States Patent [19]

Rogala

[11] Patent Number: 6,154,967

[45] Date of Patent: Dec. 5, 2000

[54] ROTATABLE PIVOTING CUTTING TOOL

[76] Inventor: Paul E. Rogala, 295 Bunnyrun Blvd., Lake Orion, Mich. 48362

[21] Appl. No.: 09/062,409

[22] Filed: Apr. 17, 1998

[51] Int. Cl.[7] ..... B26B 29/00

[52] U.S. Cl. ..... 30/292; 30/164; 30/294; 30/319

[58] Field of Search ..... 30/289, 290, 292, 30/293, 294, 151, 164, 319

[56] References Cited

U.S. PATENT DOCUMENTS

| | | | |
|---|---|---|---|
| 537,803 | 4/1895 | Deckert | 30/319 X |
| 1,594,963 | 8/1926 | James | 30/292 X |
| 1,821,718 | 9/1931 | Melcher | 30/294 X |
| 2,075,301 | 3/1937 | Pipenhagen | 30/292 |
| 2,916,062 | 12/1959 | Clauson | 30/293 X |
| 3,270,785 | 9/1966 | Molitor | 30/293 X |
| 3,576,148 | 4/1971 | Katz | 30/292 X |
| 4,062,116 | 12/1977 | Arnott | 30/292 |
| 4,393,587 | 7/1983 | Kloosterman | 30/293 X |
| 4,459,747 | 7/1984 | Salem et al. | 30/293 X |
| 4,866,847 | 9/1989 | Batrack et al. | 30/293 |
| 5,086,680 | 2/1992 | Johnson | 83/167 |
| 5,214,852 | 6/1993 | Napolitano | 30/125 |
| 5,325,594 | 7/1994 | Szafranski | 30/293 X |
| 5,485,676 | 1/1996 | Terhorst | 30/293 X |
| 5,533,269 | 7/1996 | Pickens et al | 30/293 X |
| 5,545,172 | 8/1996 | Knepshield et al. | 30/293 X |
| 5,794,347 | 8/1998 | Serpa | 30/151 X |
| 5,870,828 | 2/1999 | Polites | 30/151 X |

*Primary Examiner*—M. Rachuba
*Assistant Examiner*—Charles Goodman
*Attorney, Agent, or Firm*—Harness, Dickey & Pierce, P.L.C.

[57] ABSTRACT

A tool is described as including a pivotable guide member through which a rotatable cutting blade extends. As the cutting tool is advanced over the object to be cut, the guide member pivots in response to contacting the object which allows the object to be compressed under the guide member if desired. The guide member includes rounded first and second ends which accommodate using the cutting tool by either dragging the tool rearwardly or pushing the tool forwardly over the object.

6 Claims, 2 Drawing Sheets

ROTATABLE PIVOTING CUTTING TOOL

BACKGROUND OF THE INVENTION

1. Technical Field

The present invention relates to cutting tools and, more particularly, to cutting tools having a pivotable guide member and rotatable blade which are useful for cutting pliable objects such as fiberglass insulation, for example.

2. Background of the Art

As noted in U.S. Pat. No. 5,086,680 to Johnson, the process of cutting fiberglass insulation at a job site is often tedious and leaves room for significant error and waste. In this regard, a commonly employed method of cutting fiberglass insulation at a job site involves compressing the insulation with a board and cutting the insulation along an edge of the wood using a standard utility knife. Such a method is considered to be time consuming and often inaccurate. Further, the straight edge employed may shift which results in an insulation piece not being cut as measured. In an effort to address the aforementioned concerns, Johnson provides the art with a cutting tool which is used in association with a work board having a plurality of grooves which are received by the cutting tool blade.

While the workboard may provide for accurate cutting operations, requiring a workboard upon which the insulation must be placed is considered to be an inefficient use of time. Further, the grooves appear to be linear which do not allow deviation to shape a particular piece if so desired.

Another fiberglass insulation cutting tool which addresses some of the above described problems has been proposed by U.S. Pat. No. 5,214,852 by Napolitano. This patent relates to a hand held fiberglass insulation cutting tool designed to be dragged rearwardly over a surface of the insulation such that the fiberglass is cut and compressed using a single apparatus. While the above described cutting tool is considered to provide an advancement in the art, there are certain perceived drawbacks as to its design. For example, a hand held apparatus makes it impractical to effectuate a cutting operation for large pieces without the person having to be on their hands and knees or requiring placement of the insulation on a table to carry out a cutting operation. If the insulation has to be placed on a table, the cut piece must thereafter be returned to the installation location which is time consuming. As noted, the cutting tool can only be used by dragging the apparatus rearwardly in use which is undesirable under certain circumstances. Further, the cutting blade while touted as increasing the life of the tool would require replacement far more often than is required in accordance with the teachings of the present invention.

It is therefore an object of the present invention to provide a cutting tool which is easy and effective to use.

It is another object of the present invention to provide a cutting tool which can be used upon positioning the object to be cut upon various substrates.

It is yet another object of the present invention to provide a cutting tool wherein the replacement of parts can be carried out quickly and easily.

SUMMARY OF THE INVENTION

In view of the foregoing, the present invention generally relates to a cutting tool comprising:

a handle;

a rotatable cutting blade including a peripheral cutting edge; and a pivotable guide member including a body having a slot through which said circular cutting blade extends to effectuate a cutting operation under said guide member.

The cutting tool allows an individual to cut pieces of insulation to specific size requirements in an efficient and economical manner. As will be described in more detail below, the first and second ends of the guide member are rounded upwardly to assist in engaging the insulation piece to be cut and allowing for compression of the object being, if necessary. The handle is of sufficient length such that a cutting operation can be carried out from a standing position. Preferably, the handle is telescoping in nature to allow for length adjustment. The rotatable cutting blade and particularly the peripheral cutting edge may be formed from a carbide steel or other significantly hardened material which ensures a long and useful working life.

BRIEF DESCRIPTION OF THE DRAWINGS

These and other features of the present invention will become more clearly understood from a consideration of the following description, taken in conjunction with the accompanying drawings, in which.

DETAILED DESCRIPTION OF THE INVENTION

Figure 1:
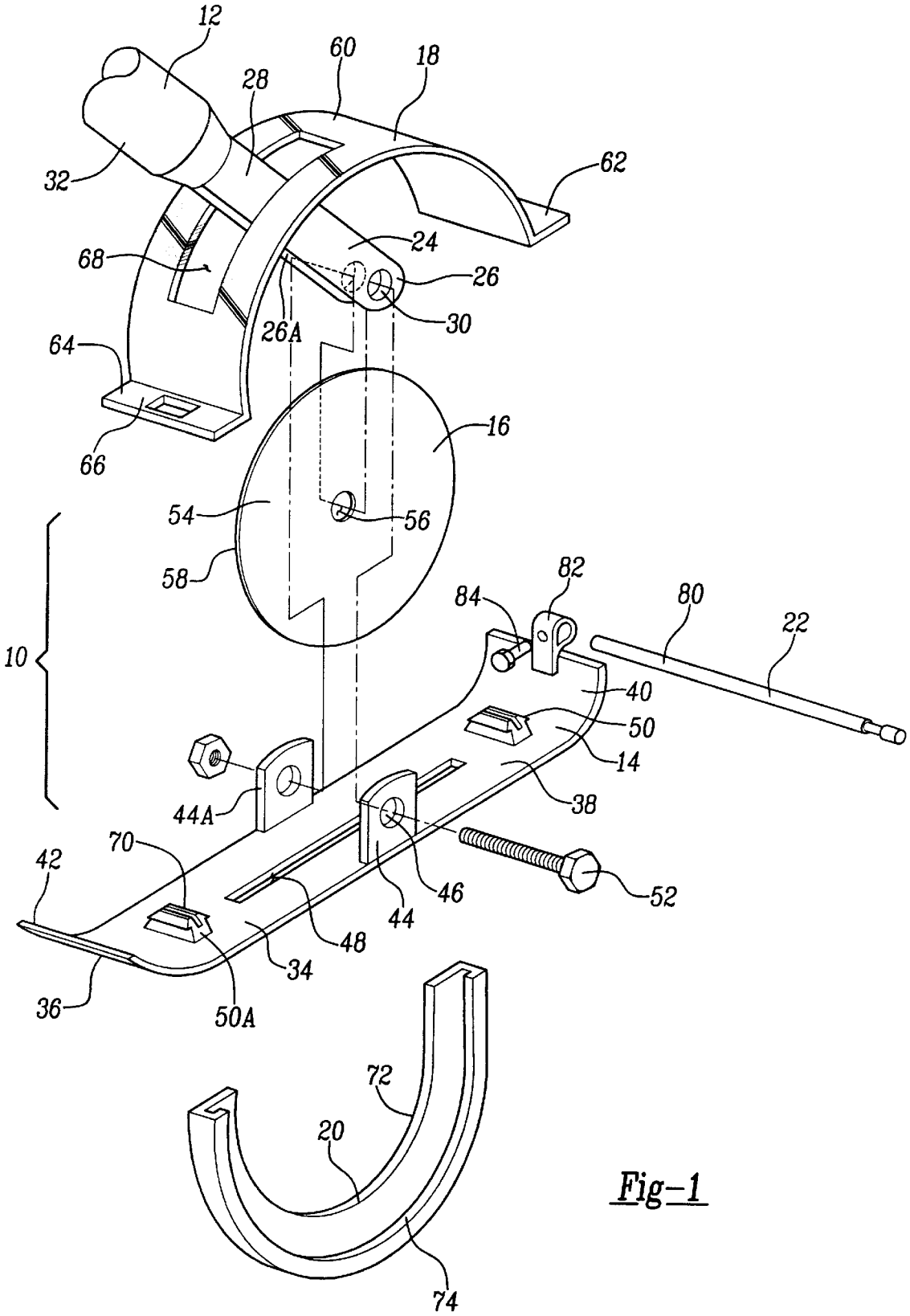
FIG. 1 is a blown apart perspective view of the cutting tool in accordance with the teachings of the present invention.

Referring to FIG. 1, there is shown a blown apart perspective view of the cutting apparatus 10 in accordance with the teachings of the present invention. The apparatus generally includes a handle 12, a pivotable guide member 14 and a rotatable cutting blade 16. Optionally, but preferably, the apparatus also includes a first blade cover 18, a second blade cover 20 and a selectively adjustable spacer 22.

The handle 12 which preferably is at least 3.0 feet in length and is optionally telescoping includes a body portion 32 having a first end 24 which includes first and second spaced apart legs 26 and 26A, respectively, which form a yoke 28. Each of the first and second legs is provided with an aperture 30 for receiving a fastener 52 for attachment of the rotatable cutting blade 16 within the yoke.

The guide member 14 includes a substantially planar body 38 including a first surface 34 and a second surface 36. Extending from the body are a first end 40 and second end 42 which preferably are rounded upwardly which allows for engagement of the object to be cut. Extending upwardly from the first surface 34 of the guide member are first and second legs 44 and 44A, respectively, which are spaced apart on opposing sides of an elongated slot 48 through which the rotatable cutting blade extends. The guide member also generally includes first and second flanges 50 and 50A for attachment of the first blade cover 18 as will be described in greater detail below. Each of the first and second legs are provided with an aperture 46 for receiving the fastener 52.

The guide member may be formed from a variety of different materials such as aluminum, stainless steel or plastic, for example. If formed from plastic, it may be desirable to use a transparent plastic, thus allowing the user to visually confirm that the cutting operation is following the intended path.

The cutting blade 16 which preferably is circular in shape includes a substantially planar body 54 having an aperture 56 disposed along the axial center point and a peripheral cutting edge 58 which is sharpened along at least one side of the body to allow for cutting as the tool is advanced over the object to be cut. The body 54 or at least the cutting edge 58 thereof may be formed from a hardened material such as carbide steel, for example, to improve the useful life of the blade.

The first blade cover 18 which is selectively removable generally includes an arcuate body 60 and first and second substantially planar ends 62 and 64, respectively. The ends 62 and 64 may be bonded to the first surface 34 of the guide member or releasably attached to flanges 50 and 50A provided along the first surface 34 of the guide member. The first blade cover also includes an elongated slot 68 through which the terminal first end 24 of the handle 12 extends upon assembly. The first blade cover 18 may also be formed from a metal or plastic material which can optionally be transparent.

A second blade cover 20 which is designed to snap fit over the peripheral edge of the rotatable cutting blade is also contemplated. Thus, the second cover 20 includes a body 72 having a substantially U-shaped web 74 for receiving the peripheral edge.

Figure 4:
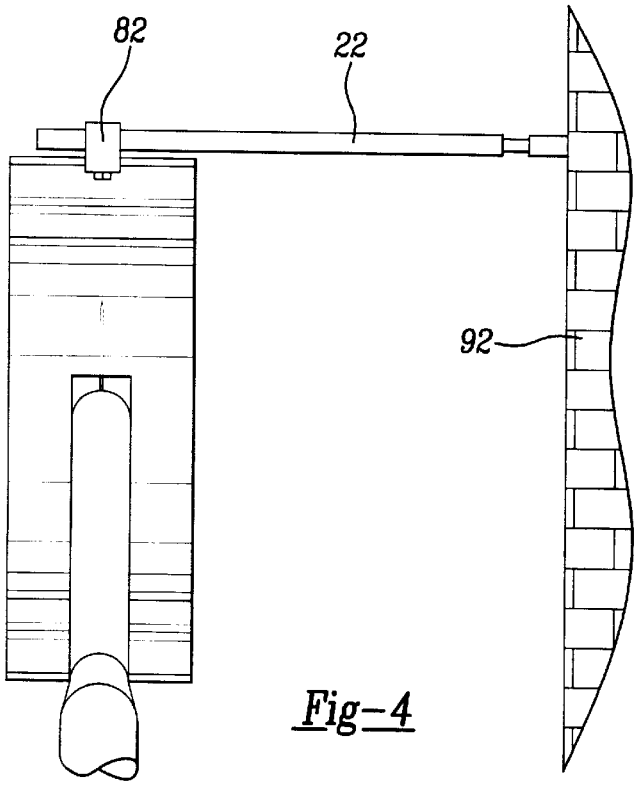
FIG. 4 is a top elevational view showing the cutting tool being spaced from a barrier to assist in effectuating an accurate cutting operation.

Referring to FIG. 4, the selectably adjustable spacer 22 extends through the retainer 82 attached along the first end 40 of the guide member such that accurate cutting operations can be carried out in proximity to a wall or barrier 92. Alternatively, the spacer can be adjusted within the retainer such that the end of the spacer is aligned with an edge or pre-marked pattern on the object being cut. This allows for a visual verification that the cutting blade is following the intended path. In order to adjust the spacer 22, the fastener 84 can be loosened and tightened as desired.

Figure 2:
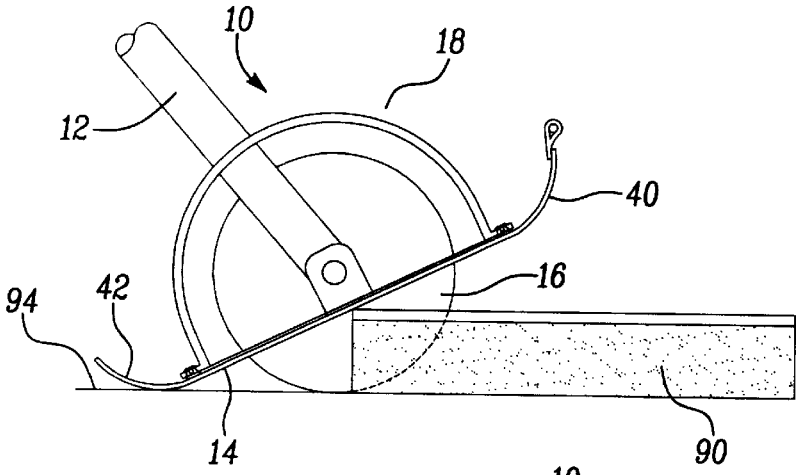
FIG. 2 is a side elevational view illustrating the cutting tool initially engaging a piece of fiberglass insulation.
Figure 3:
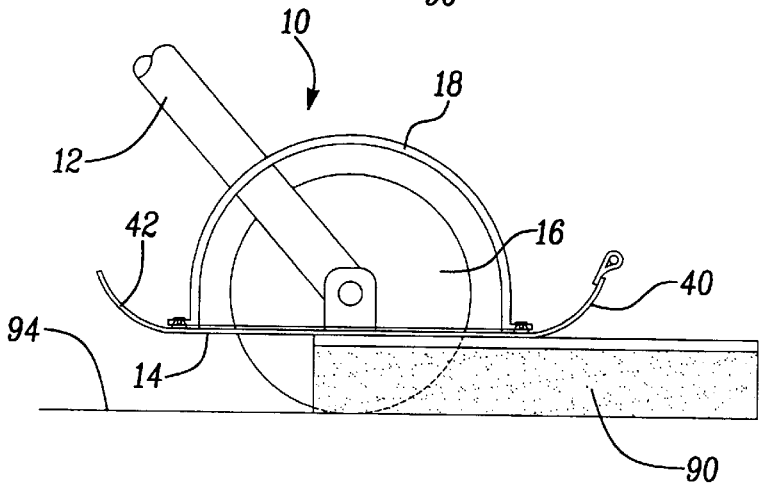
FIG. 3 is a side elevational view illustrating the cutting tool being advanced over the insulation.

Operation of the cutting tool 10 is illustrated most clearly with reference to FIGS. 2 and 3. The cutting tool 10 is advanced over an object 90 such as a piece of fiberglass or foam insulation such that the first end 40 of the guide member is pivoted upwardly and the second end 42 generally rests upon the substrate 94 over which the object 90 is positioned for cutting. As the cutting tool is advanced forwardly over the object, the guide member 14 may compress the object 90 by exerting force downwardly on the handle 12. The guide member thus pivots about fastener 52 such that the first end 40 rotates downwardly and simultaneously the second end 42 rotates upwardly with respect to the object and substrate. As should be understood by a review of the foregoing description and reference to the accompanying drawings, the guide member of the cutting tool would pivot in the opposite direction if dragged rearwardly to effectuate a cutting operation.

While it will be apparent that the preferred embodiments of the invention disclosed are well calculated to fulfill the objects stated, it will be appreciated that the invention is susceptible to modification, variation and change without departing from the spirit thereof.

What is claimed is:

1. A cutting tool comprising:

a handle including a yoke along one end thereof;

a rotatable cutting blade disposed within said yoke, said blade including a peripheral cutting edge and a rotation axis; and a pivotable guide member including a body and a pair of spaced apart legs extending upwardly from a first surface of said guide member, said body including a slot through which said rotatable cutting blade extends to effectuate a cutting operation under said guide member and said legs mounting said yoke coaxial with said rotation axis.

2. The cutting tool of claim 1 wherein said guide member includes an upwardly extending first end.

3. The cutting tool of claim 1 wherein said guide member includes an upwardly extending second end.

4. The cutting tool of claim 1 further comprising a first blade cover attachable to said pivotable guide member.

5. The cutting tool of claim 4 wherein at least a portion of said first blade cover is transparent.

6. The cutting tool of claim 1 further comprising a selectively adjustable spacer attached to said guide member.

* * * * *